US008899003B2

(12) United States Patent
Mueller et al.

(10) Patent No.: US 8,899,003 B2
(45) Date of Patent: Dec. 2, 2014

(54) METHODS OF PROVIDING STACKS OF WET WIPES WITH IMPROVED WETNESS GRADIENTS

(75) Inventors: Joerg Mueller, Karben (DE); Randall Glenn Marsh, Hamilton, OH (US); Jacqueline Marie Duderstadt, Cincinnati, OH (US); Luis Omar Gonzalez Mendez, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 750 days.

(21) Appl. No.: 13/053,629

(22) Filed: Mar. 22, 2011

(65) Prior Publication Data

US 2012/0241333 A1 Sep. 27, 2012

(51) Int. Cl.

| | |
|---|---|
| ***B65D 81/24*** | (2006.01) |
| ***B65B 55/00*** | (2006.01) |
| ***B65D 83/08*** | (2006.01) |
| ***B65D 81/22*** | (2006.01) |

(52) U.S. Cl.

CPC ..... *B65D 81/22* (2013.01); *B65D 81/24* (2013.01); *B65D 83/0805* (2013.01)

USPC ..... 53/544; 53/143

(58) Field of Classification Search

USPC ..... 53/143, 144, 544

See application file for complete search history.

(56) References Cited

U.S. PATENT DOCUMENTS

| | | | | |
|---|---|---|---|---|
| 4,623,074 A | | 11/1986 | Dearwester | |
| 4,768,679 A | * | 9/1988 | Matsui | 221/48 |
| 5,143,679 A | | 9/1992 | Weber et al. | |
| 5,201,164 A | | 4/1993 | Kaufman | |
| 5,379,897 A | | 1/1995 | Muckenfuhs et al. | |
| 5,516,001 A | | 5/1996 | Muckenfuhs et al. | |

(Continued)

FOREIGN PATENT DOCUMENTS

| | | |
|---|---|---|
| DE | 20 2004 011103 U1 | 12/2004 |
| EP | 1 048 589 A1 | 11/2000 |

(Continued)

OTHER PUBLICATIONS

PCT International Search Report, mailed May 23, 2012, 12 pages.

(Continued)

*Primary Examiner* — Hemant M Desai

(74) *Attorney, Agent, or Firm* — Amy M. Foust; Abbey A. Lopez; Kelly L. McDow

(57) ABSTRACT

A method of reducing a wetness gradient development for a package of wet wipes is provided. The method includes, after wet wipes are enclosed within a package to form the package of wet wipes, locating the package of wet wipes in a first orientation such that a first side of the package of wet wipes faces downward and an opposite second side of the package of wet wipes faces upward to form a first wetness gradient after a preselected amount of time. Prior to opening the package of wet wipes to access the wet wipes enclosed within the package of wet wipes, inverting the package of wet wipes according to a predetermined turning schedule to place the package of wet wipes in a second orientation such that the first side of the package of wet wipes faces upward and the second side of the package of wet wipes faces downward to form a second wetness gradient that is different from the first wetness gradient.

26 Claims, 9 Drawing Sheets

(56) References Cited

U.S. PATENT DOCUMENTS

| | | | | |
|---|---|---|---|---|
| 5,518,801 | A | 5/1996 | Chappell et al. | |
| 5,628,097 | A | 5/1997 | Benson et al. | |
| 5,648,083 | A | 7/1997 | Blieszner et al. | |
| 5,658,639 | A | 8/1997 | Curro et al. | |
| 5,785,179 | A | 7/1998 | Buczwinski et al. | |
| 5,914,084 | A | 6/1999 | Benson et al. | |
| 5,916,661 | A | 6/1999 | Benson et al. | |
| 6,114,263 | A | 9/2000 | Benson et al. | |
| 6,129,801 | A | 10/2000 | Benson et al. | |
| 6,383,431 | B1 | 5/2002 | Dobrin et al. | |
| 6,613,729 | B1 | 9/2003 | Cole et al. | |
| 6,641,826 | B2 | 11/2003 | Durden | |
| 6,673,358 | B1 | 1/2004 | Cole et al. | |
| 7,530,471 | B2 * | 5/2009 | Cohen et al. | 221/48 |
| 7,666,827 | B2 | 2/2010 | Marsh et al. | |
| 2003/0028165 | A1 | 2/2003 | Curro et al. | |
| 2003/0062375 | A1 * | 4/2003 | Christensen et al. | 221/46 |
| 2004/0022158 | A1 | 2/2004 | Kando et al. | |
| 2004/0094004 | A1 | 5/2004 | Julius | |
| 2004/0131820 | A1 | 7/2004 | Turner et al. | |
| 2004/0265534 | A1 | 12/2004 | Curro et al. | |
| 2005/0008680 | A1 | 1/2005 | Deckner et al. | |
| 2005/0008681 | A1 | 1/2005 | Deckner et al. | |
| 2005/0194395 | A1 | 9/2005 | Julius | |
| 2006/0171971 | A1 | 8/2006 | Marsh et al. | |
| 2006/0283750 | A1 | 12/2006 | Villars et al. | |
| 2007/0286893 | A1 | 12/2007 | Marsh et al. | |
| 2007/0286894 | A1 | 12/2007 | Marsh et al. | |
| 2011/0268777 | A1 * | 11/2011 | Marsh et al. | 424/401 |

FOREIGN PATENT DOCUMENTS

| | | | |
|---|---|---|---|
| EP | 1 388 503 | A1 | 2/2004 |
| WO | WO 2005/004834 | A1 | 1/2005 |
| WO | WO 2005/007128 | A1 | 1/2007 |
| WO | WO 2007/144814 | A1 | 12/2007 |
| WO | WO 2007/144819 | A1 | 12/2007 |

OTHER PUBLICATIONS

Free & Cheap Pampers Wipes at Various Stores at www.hip2save.com, dated Jun. 2010, comment 4.2 dated Jun. 6, 2010 at 8:26 pm EST, 15 pages.

Store Wipes Upside Down at www.thirftyfun.com, dated Nov. 16, 2007, 2 pages.

Today's Beauty Tips: Makeup Removing at www.christineiverson.blogspot.com, dated Nov. 2010, 4 pages.

How to Make Organic Baby Wipes at www.ehow.com, 1 page, dated Mar. 23, 2011.

* cited by examiner

METHODS OF PROVIDING STACKS OF WET WIPES WITH IMPROVED WETNESS GRADIENTS

FIELD OF THE INVENTION

The present invention is generally directed to stacks of wet wipes, and more particularly, to methods of reducing a wetness gradient in a stack of wet wipes.

BACKGROUND OF THE INVENTION

Stacks of substrates, specifically stacks of wet wipes, are typically pre-moistened with various compositions for ease in cleaning, disinfecting, and providing skin care benefits (e.g., moisturizing). Such stacks of substrates (i.e., wet wipes) are typically placed within packages for shipping, storage, sale, and dispensing. As used herein, "substrate" refers to a piece of material used in cleaning or treating various surfaces, such as food, hard surfaces, inanimate objects, body parts, etc. For example, many currently available substrates may be intended for the cleansing of the peri-anal area after defecation. Other substrates may be available for the cleansing of the face or other body parts. A "substrate" may also be known as a "wipe" and both terms may be used interchangeably. The substrates (e.g., wipes) are typically fabricated from non-woven materials, but can be fabricated from woven and other materials. Illustrative compositions may include, but are not limited to lotions, cleaning compositions, polishes, etc.

SUMMARY OF THE INVENTION

In one embodiment, a method of reducing a wetness gradient development for a package of wet wipes is provided. The method includes, after wet wipes are enclosed within a package to form the package of wet wipes, locating the package of wet wipes in a first orientation such that a first side of the package of wet wipes faces downward and an opposite second side of the package of wet wipes faces upward to form a first wetness gradient after a preselected amount of time. Prior to opening the package of wet wipes to access the wet wipes enclosed within the package of wet wipes, inverting the package of wet wipes according to a predetermined turning schedule to place the package of wet wipes in a second orientation such that the first side of the package of wet wipes faces upward and the second side of the package of wet wipes faces downward to form a second wetness gradient that is different from the first wetness gradient.

In another embodiment, a method of reducing wetness gradient development for multiple packages of wet wipes prior to consumer purchase is provided. The method includes locating the multiple packages of wet wipes, the multiple packages of wet wipes being in a first orientation such that a first side of each multiple package of wet wipes faces downward and a second side of each multiple package of wet wipes faces upward. The multiple packages of wet wipes are inverted at least about 24 hours after the multiple packages of wet wipes are placed in their first orientations to place the multiple packages of wet wipes in a second orientation such that the first side of each multiple package of wet wipes faces upward and the second side of each multiple package of wet wipes faces downward prior to sale of the multiple packages of wet wipes to a consumer.

In another embodiment, a method of reducing wetness gradient development for multiple packages of wet wipes prior to consumer purchase is provided. The method includes locating the multiple packages of wet wipes with the wet wipes located therein in stacks. The multiple packages of wet wipes are in an upside down orientation such that a top of each multiple package of wet wipes faces downward and a bottom of each multiple package of wet wipes faces upward. Prior to opening the multiple packages of wet wipes to access the wet wipes sealed within the multiple packages of wet wipes, the multiple packages of wet wipes are inverted from their upside down orientations to a right-side up orientation such that the top of each multiple package of wet wipes faces upward and the bottom of each multiple package of wet wipes faces downward. The stacks of wet wipes of the multiple packages of wet wipes have a wetness gradient of no greater than about 1.3 at least about 10 days after being inverted from the upside down orientation to the right-side up orientation and prior to opening the multiple packages of wet wipes.

BRIEF DESCRIPTION OF THE DRAWINGS

The following detailed description of specific embodiments of the present invention can be best understood when read in conjunction with the drawings enclosed herewith.

Figure 1:
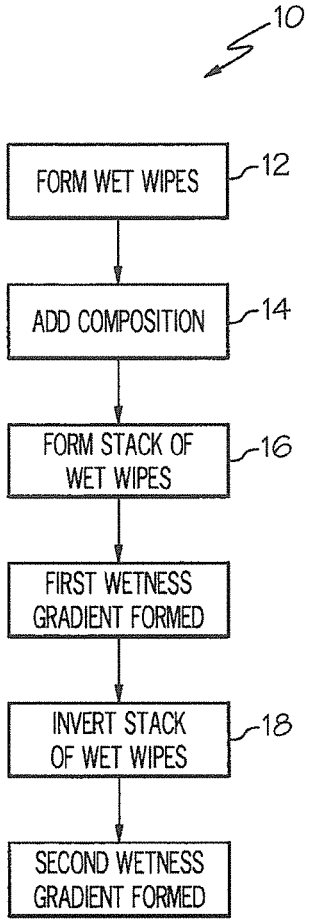
FIG. 1 illustrates an embodiment of a method of reducing a wetness gradient in a stack of wet wipes.

The embodiments set forth in the drawings are illustrative in nature and not intended to be limiting of the invention defined by the claims. Moreover, individual features of the drawings and invention will be more fully apparent and understood in view of the detailed description.

DETAILED DESCRIPTION OF THE INVENTION

The following text sets forth a broad description of numerous different embodiments of the present invention. The description is to be construed as exemplary only and does not describe every possible embodiment since describing every possible embodiment would be impractical, if not impossible, and it will be understood that any feature, characteristic, component, composition, ingredient, product, step or methodology described herein can be deleted, combined with or substituted for, in whole or part, any other feature, characteristic, component, composition, ingredient, product, step or methodology described herein. Numerous alternative embodiments could be implemented, using either current technology or technology developed after the filing date of this patent, which would still fall within the scope of the claims. All publications and patents cited herein are incorporated herein by reference.

It should also be understood that, unless a term is expressly defined in this specification using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). No term is intended to be essential to the present invention unless so stated. To the extent that any term recited in the claims at the end of this patent is referred to in this patent in a manner consistent with a single meaning, that is done for sake of clarity only so as to not confuse the reader, and it is not intended that such a claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

It has been discovered that moisture management, specifically relating to wetness distribution, can be quite challenging in stacks of substrates comprising a composition, such as a lotion or cleanser. While the wetness distribution is almost homogeneous in a stack of substrates when the substrates are produced and stacked, capillary forces, gravitational forces, evaporation and condensation can change this distribution and cause undesired effects on the product properties and a wetness gradient in the substrate stacks.

It has been further discovered that wetness gradient can impact wetness perception, cleaning, and dispensing. Uniform wetness through the stack of substrates is a consumer desire and failure to meet the expectation is generally captured through consumer comments. Consumers often complain of "dryness" in the stack of substrates, and this negative attribute is generally caused by a combination of dry uppermost substrates and uneven wetness throughout the stack.

A current problem with stacks of substrates, specifically stacks of wet wipes, is that after storage of the stack of wipes, the composition or lotion tends to migrate towards the bottom of the stack. This results in a stack that has an uneven distribution of the composition or lotion on the individual wipes with the upper wipes often becoming too dry while the lower wipes become over saturated with lotion.

Wetness distribution in a stack of substrates, specifically a stack of wet wipes, is based on a wetness gradient. The wetness gradient indicates the difference between the lotion loading of the wet wipes at the bottom of the stack of wipes relative to those wet wipes at the top of the stack of wipes and expresses this difference as a numerical ratio greater than 1. A ratio of 1 means that the lotion loading of the wet wipes at the bottom and top of the stack of wipes are identical, i.e. that no lotion gradient is present. A ratio of 2 means that the wipes at the bottom of the stack contain twice as much lotion as the wipes at the top, and so forth.

Stacks of substrates, specifically stacks of wet wipes, described herein are provided with an improved product handling method which allows a first wetness gradient to form in the stack and then the stacks are turned from one side to a different side, such as inverted, according to a predetermined turning schedule to allow a second wetness gradient to form in the stacks. Without wishing to be bound by theory, it is believed that in this manner, the second wetness gradient can be significantly reduced compared to the first wetness gradient. Tests for determining wetness gradient in a stack of wet wipes are set forth below. Unless otherwise specified, experiments are conducted under standard laboratory conditions: temperature: 21° C.±2° C., relative humidity: 30-50%.

1. Determining Wetness Gradient in a Marketed Stack of Wipes

For each type of marketed wet wipe to be tested, a total of three independent packages are required. The three packages must be opened and tested sequentially to prevent significant moisture loss prior to measurements being taken. Prior to the opening of a package and commencement of testing, the orientation of the wipe stack in the package must have remained the same as when purchased on the store shelf, i.e., at no time can the stack have experienced a partial or complete inversion between the time of purchase and the opening of the package. Any packages that are known or suspected to have undergone an inversion must be discarded.

Working with the first package of the three, the stack of wipes is removed from the packaging. If the wet wipes are in flow-wrap, one end of the flow-wrap package is carefully cut open to enable removal of the stack of wipes without unduly disturbing it, i.e., without folding, bending, or compressing the wet wipes. If the wet wipes are in a tub, the stack of wipes can carefully be lifted out, again without unduly disturbing it. The naked stack of wipes is immediately weighed on a pre-tared three-place balance in the same orientation as it was in the package and the weight is recorded. While the weight of the naked stack will not be used in the calculation of the wetness gradient, it will serve as an indicator of whether moisture loss through the package was similar for each of the wipe stacks in the set of three. More detail about this indicator and its use is provided below.

Working quickly, the top wipe is removed from the stack of wipes by gripping it near an edge with forceps, lifting it gently, and placing it onto a pre-tared balance. The weight is recorded. The wipe is discarded, and the process is repeated until the top ten individual wipes have been weighed and their weights recorded.

The stack of wipes is then flipped over to expose the bottom wipes. Working quickly, the upper-most wet wipe is removed and weighed as described above. The wet wipe is discarded, and the process is repeated until ten individual wipes from the bottom of the stack of wipes have been weighed and their weights recorded.

The total time from opening of the stack of wipes to weighing of the last wet wipe must not have exceeded five minutes for the data to be used for subsequent calculations. Taking longer than five minutes increases the risk for significant evaporative moisture loss from the wet wipes.

The entire sequence above is repeated for the remaining two stacks.

Several calculations are now performed on the data obtained. First, using the weight of each naked stack from the set of three stacks for a given wipe type, an Indicator of Relative Moisture Loss Through Package is generated as follows:

a. The average naked stack weight is calculated for the three independent stacks.
b. The standard deviation is calculated for this same data.
c. The coefficient of variability is calculated by dividing the standard deviation by the mean and expressing the resulting number as a percentage.

The Indicator of Relative Moisture Loss Through Package is equal to the coefficient of variability. This value must be less than 10%. If the value exceeds 10%, the data for that set of three stacks can not be used for calculating a wetness gradient because it is likely that excessive moisture loss has occurred in at least one package.

Once it has been determined that the Indicator of Relative Moisture Loss Through Package is 5% or less, the next step is to calculate the Wetness gradient as follows:

average naked stack weight of bottom wipes/average naked stack weight of top wipes=Wetness gradient.

2. Determining Impact of Stack Inversion on Wetness Gradient

This method requires a total of six independent packages for each wet wipe option being tested. Three of these packages will remain in the same orientation throughout the testing while three will undergo an inversion at a specified time.

Prior to commencing the test, the orientation of the wipe stack in the package must have remained the same as when it was manufactured or purchased on the store shelf, i.e. at no time can the stack have experienced a partial or complete inversion prior to the test beginning. Any packages that are known or suspected to have undergone an inversion must be discarded.

To start, the packages to be tested are labeled with the name of the wipe option, with instructions to flip or not flip, with the date to be flipped, and with the date the test ends. All packages are then set aside with a cautionary note to leave undisturbed.

After two weeks of sitting undisturbed, three packs within each set of six are flipped over (inverted 180 degrees) while the remaining three packs remain in their original position.

After all the packs have sat undisturbed for an additional five weeks, the wet wipes are then analyzed in two sets of three corresponding to the flipped and unflipped stacks for a given type of wet wipe. Each package of the two sets is opened and tested sequentially to prevent significant moisture loss prior to measurements being taken.

Working with the first package of the first set of three, the stack of wipes is removed from the packaging. If the wet wipes are in flow-wrap, one end of the flow-wrap package is carefully cut open to enable removal of the stack of wipes without unduly disturbing it, i.e. without folding, bending, or compressing the wet wipes. If the wet wipes are in a tub, the stack of wipes can carefully be lifted out, again without unduly disturbing it. The naked stack of wet wipes is immediately weighed on a pre-tared three-place balance in the same orientation as it was in the package and the weight is recorded. While the weight of the naked stack of wet wipes will not be used in the calculation of the lotion gradient, it will serves as an indicator of whether moisture loss through the package was similar for each of the wipe stacks in the set of three. More detail about this indicator and its use is provided below.

Working quickly, the top wipe is removed from the stack of wipes by gripping it near an edge with forceps, lifting it gently, and placing it onto a pre-tared balance. The weight is recorded. The wipe is discarded, and the process is repeated until the top ten individual wipes have been weighed and their weights recorded.

The stack of wipes is then flipped over to expose the bottom wipes. Working quickly, the upper-most wipe is removed and weighed as described above. The wipe is discarded, and the process is repeated until ten individual wipes from the bottom of the stack of wipes have been weighed and their weights recorded.

The total time from opening of the stack of wet wipes to weighing of the last wipe must not have exceeded five minutes for the data to be used for subsequent calculations. Taking longer than five minutes increases the risk for significant evaporative moisture loss from the wipes.

The entire sequence above is repeated for the remaining two stacks of the first set.

Several calculations are now performed on the data that has been obtained. First, using the weight of each naked stack from the two sets of three stacks for a given wipe type, an Indicator of Relative Moisture Loss Through Package of each of the two sets is generated as follows:

a. The average naked stack weight is calculated for the three independent stacks.
b. The standard deviation is calculated for this same data.
c. The coefficient of variability is calculated by dividing the standard deviation by the mean and expressing the resulting number as a percentage.

The Indicator of Relative Moisture Loss Through Package is equal to the coefficient of variability. This value must be less than 10%. If the value exceeds 10%, the data for that set of three stacks can not be used for calculating a lotion gradient because it is likely that excessive moisture loss has occurred in at least one package.

Once it has been determined that the Indicator of Relative Moisture Loss Through Package is 5% or less, the next step is to calculate the Wetness gradient for each of the two sets as follows:

average naked stack weight of bottom wipes/average naked stack weight of top wipes=Wetness gradient.

The ideal wetness gradient value is as close to one as possible, which lends itself to a uniform composition loading (e.g., lotion loading) throughout the stack. Deviations from one are likely to generate consumer complaints for dryness depending on the degree of deviation. Stacks on the shelf commonly have wetness ratios of about 1.5 or greater.

Referring to FIG. 1, a method 10 of reducing a wetness gradient in a stack of wet wipes includes forming a plurality of wet wipes at step 12 that are impregnated with a composition at step 14. The composition may be a liquid or semi-liquid composition, and include any of the illustrative compositions set forth herein or any other desirable compositions. At step 16, the plurality of wet wipes may be placed in a stack, one wet wipe over another. In some embodiments, adjacent wet wipes may be interleaved between folds to form an interleaved stack of wet wipes.

A wetness gradient begins to form due to gravity soon after the stack of wet wipes is assembled. That is, gravity tends to pull the composition from the wipes of higher elevation of the stack toward the wipes of the lower elevation of the stack. Without wishing to be bound by theory, it is believed that the wetness gradient increases somewhat exponentially over time and levels off at around a steady state wetness gradient after a period of time. This leveling off of the wetness gradient at a steady state wetness gradient may be due, at least in part, to capillary action present in the wet wipes due to pore structures provided by the substrates, which favor fluid retention. As used herein, the "steady state wetness gradient" is that wetness gradient which changes no more than about two percent after a period of 10 days. The time it takes for the steady state wetness gradient to form can depend on a number of factors including the properties of the substrate, the properties of the composition, number of wet wipes, type of packaging, etc.

The steady state wetness gradient can be reduced by allowing an initial wetness gradient to form up to and including the steady state wetness gradient and then inverting the stack of wet wipes to allow a second wetness gradient to begin to form. It has been found that the second steady state wetness gradient may be less than the initial steady state wetness gradient. For example, the initial steady state wetness gradient may be greater than 1.5 and the second steady state wetness gradient may be 1.5 or less, such as 1.3 or less, such as 1.2 or less, such as 1.1 or less. This reduction in the steady state wetness gradient is believed to be an effect related to chromatography—the movement of the composition (e.g. lotion) through the stack of wet wipes in the first instance may change the substrate physically (e.g., blocking a subset of pores), chemically (e.g., coating fibers with components comprising the composition), or both, such that moisture is retained differently during formation of the second wetness gradient.

At step 18, once the first wetness gradient has formed, the stack of wet wipes is inverted to form a second wetness gradient. The stack of wet wipes may be inverted (i.e., flipped 180 degrees) according to a predetermined turning schedule using a variety of methods, some of which are described below. A "predetermined turning schedule" refers to a plan or program indicating a sequence of handling events and may include items such as timing.

Figure 2:
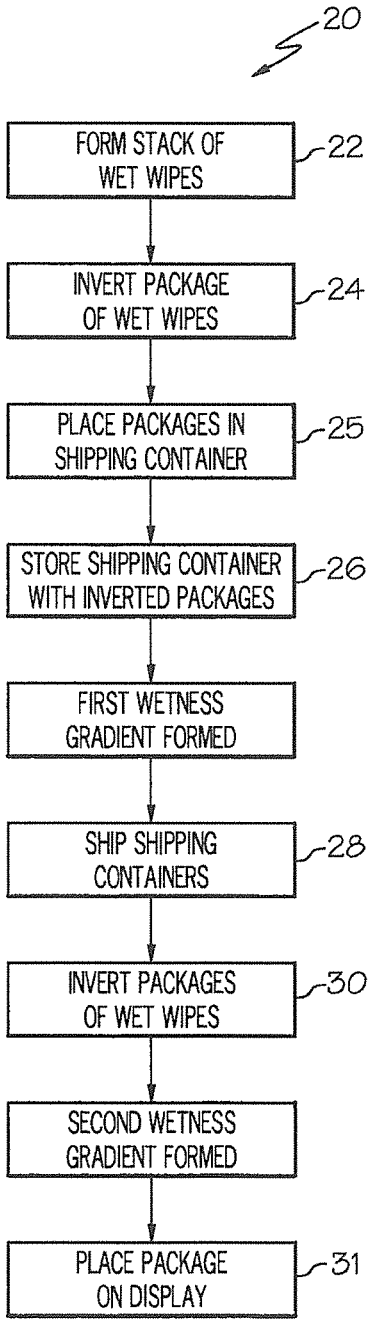
FIG. 2 illustrates another embodiment of a method of reducing a wetness gradient in a stack of wet wipes.

Referring to FIG. 2, one exemplary method 20 of reducing a wetness gradient in a stack of wet wipes includes forming a stack of wet wipes at step 22. Wet wipes may be stacked inside or outside of a package in either a folded or unfolded configuration. Wet wipes may be stacked and arranged in a folded configuration such as a c-folded, z-folded or quarter-folded configuration, as examples. The folded wet wipes may be interfolded with the wet wipes immediately above and below in the stack of wet wipes. Illustrative packages for holding the stack of wet wipes may include flow wrap packages, tubs, etc. In many instances, the packages may include an opening feature that facilitates user access to the stack of wet wipes. Various opening features are described below.

At step 24, once the stack of wet wipes is placed in the package, the package with the wet wipes may be inverted and placed inside a shipping container upside down with a top of the package facing down (or toward a bottom of the shipping container) and a bottom of the package facing up (or toward a top of the shipping container). Step 24 may be referred to as an initial inversion of the stack of wet wipes. In this upside down orientation, the composition within the stack tends to migrate from the wipes of higher elevation toward the wipes of lower elevation. In some embodiments, the initial inversion of the stack of wet wipes may be performed according to a predetermined turning schedule. For example, the initial inversion of the stack of wet wipes may occur within a predetermined period of time of forming the stack of wet wipes, such as within about 21 days, such as within about 14 days, such as within about 10 days, such as within about one day, such as within about one hour, such as within about five minutes of forming the stack of wet wipes.

Any suitable process may be used to provide the initial inversion of the stack of wet wipes. In some embodiments, the initial inversion of the stack of wet wipes may be performed automatically using a packaging machine or robot. In another embodiment, the initial inversion of the stack of wet wipes may be performed manually. In the embodiment of FIG. 2, the initial inversion of the stack of wet wipes is performed at the manufacturing facility where the packages are placed upside down automatically inside the shipping containers at step 25.

The initial inversion of the stack of wet wipes is performed for multiple packages. In some embodiments, all of the packages of wet wipes within a particular shipping container are inverted such that the tops of the packages face down and the bottoms of the packages face up within the shipping container. In other embodiments, only some of the packages of wet wipes within a particular shipping container are inverted such that the tops of the packages face down and the bottoms of the packages face up.

At step 26, the shipping container of inverted packages of wet wipes or multiple shipping containers of inverted packages of wet wipes may be stored within the manufacturing facility or at a different location. In some embodiments, the shipping containers of inverted packages of wet wipes may be stored according to the predetermined turning schedule. As one example, the shipping containers of inverted packages of wet wipes may be stored for at least about 10 days or more, such as about 14 days or more, such as about 21 days or more with the packages of wet wipes in their upside down orientations and without any flipping of the packages.

At step 28, the shipping containers of inverted packages of wet wipes are shipped to a retail location. The retail location may be a store, e.g. a retail outlet, wholesale outlet, restaurant, branch office or other physical location where transactions involving goods or services occur between the user and the store. At step 30, once the shipping containers are opened, the packages may be inverted according to the predetermined turning schedule. In this instance, the predetermined turning schedule may specify that the packages of wet wipes are to be inverted at the retail location. As one example, the packages of wet wipes may be inverted by an employee of the retail location as they are placed on a shelf for display at step 31 such that the bottom of the package faces down and a top of the package faces up. As another example, the shipping container may be inverted at the retail location and then opened such that the packages within the shipping container are inverted. Any suitable inversion method may be employed that rotates the packages 180 degrees for placement on display for user purchase.

Once the packages with the wet wipes are inverted with tops of the packages facing up and the bottoms of the packages facing down, a second wetness gradient begins to form. In this right-side up orientation, the composition tends to migrate from the wipes of higher elevation toward the wipes of lower elevation. The second inversion of the stack of wet wipes may occur after a predetermined period of time of the initial inversion, such as at least about 10 days, such as at least about 14 days, such as at least about 21 days, such as between about 10 days and about 21 days. The timing for the second inversion of the stack of wet wipes may be selected to occur after the initial steady state wetness gradient develops. In other embodiments, the timing for the second inversion of the stack of wet wipes may be selected to occur before the initial steady state wetness gradient develops, but after the initial wetness gradient begins to form.

Figure 3:
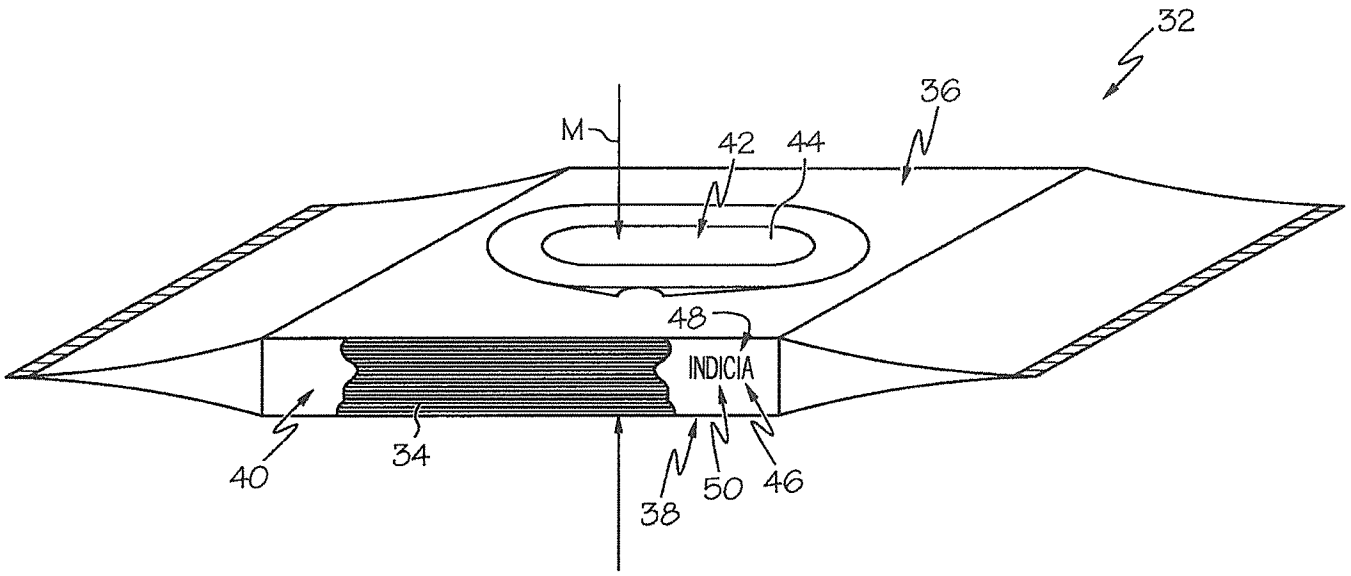
FIG. 3 is a perspective view of an embodiment of a package of wet wipes in a right-side up orientation.

Referring to FIG. 3, an exemplary flow wrap-type package 32 is illustrated in a right-side up orientation, which may be used to house a stack of wet wipes 34. The package 32 includes a top side 36, a bottom side 38 and sidewalls 40 that extend from the top side 36 to the bottom side 38. The sidewalls 40 of the package 32 need not be flaccid and/or resiliently deformable, as depicted, but may instead be freestanding and rigid. This flaccid arrangement may provide the package 32 with a somewhat amorphous shape. Material such as polyethylene film may be suitable if flaccid sidewalls 40, top side 36, and/or bottom side 38 are selected for the package 32. A suitable package 32 may be made in accordance with the teachings of U.S. Pat. No. 5,379,897 issued Jan. 10, 1995 to Muckenfuhs et al., which is hereby incorporated by reference herein in its entirety. The package 32 may also be lightweight. By "lightweight" it is meant the package 32 is conveniently portable and does not have dead weight specifically added thereto. Alternatively, the sidewalls 40, top side 36, and/or bottom side 38 may be rigid. Suitable materials for rigid sidewalls 40, top 36, and/or bottom 38 may include HDPE and PP.

The package 32 may include an opening feature 42. The opening feature 42 may be located at the top side 36 and/or bottom side 38 of the package 32. In some embodiments, the opening feature 42 may intercept the top side 36 and one of the other sidewalls 40 of the package 32, so that the wet wipes 34 may be dispensed in either a pop-up manner or a reach-in manner. An exemplary package 32 and opening feature 42 may be made in accordance with, for example, U.S. Pat. No. 4,623,074 issued Nov. 18, 1986 to Dearwester or U.S. Pat. No. 5,516,001 issued May 14, 1996 to Muchenfuhs et al., which are hereby incorporated by reference herein in their entirety. In some embodiments, the opening feature 42 may include a reclosable feature, such as a lid 44 or an adhesive flap. The lid 44 may have a hinge (not shown) that allows for opening and closing of the lid 44.

The opening feature 42 may be any variety of shapes, and intercept one or more sides of the package 32. The sides may provide a major depth M. The major depth M may be parallel to and may be measured coincident with a major axis, which passes through the top side 36 and the bottom side 38 and also passes through a center of the package 32 when filled with the stack of wet wipes 34. The major depth M of the package 32 may be vertical if the package 32 is placed on a horizontal surface or reference plane such as a table, shelf, countertop, or similar surface. Such a package 32 may have a primary dispensing direction generally parallel to the major axis and through one or both of the top side 36 and the bottom side 38.

The package 32 may include indicia 46 printed or attached thereon that is visible to the user from outside the package. The term "indicia" refers to an identifying marking, which may include words and/or graphics describing a product in use. At least some of the indicia 46 may have a generally right-side up orientation where a top 48 of the indicia 46 is closer to the top side 36 of the package 32 and a bottom 50 of the indicia 46 is closer to the bottom side 38 of the package 32. For indicia including text, right-side up refers to the normal reading orientation of the text. For logos, marks, etc. not including text, right-side up may refer to any design, mark, etc. in its orientation as registered with a governing body such as the United States Patent and Trademark Office.

Figure 4:
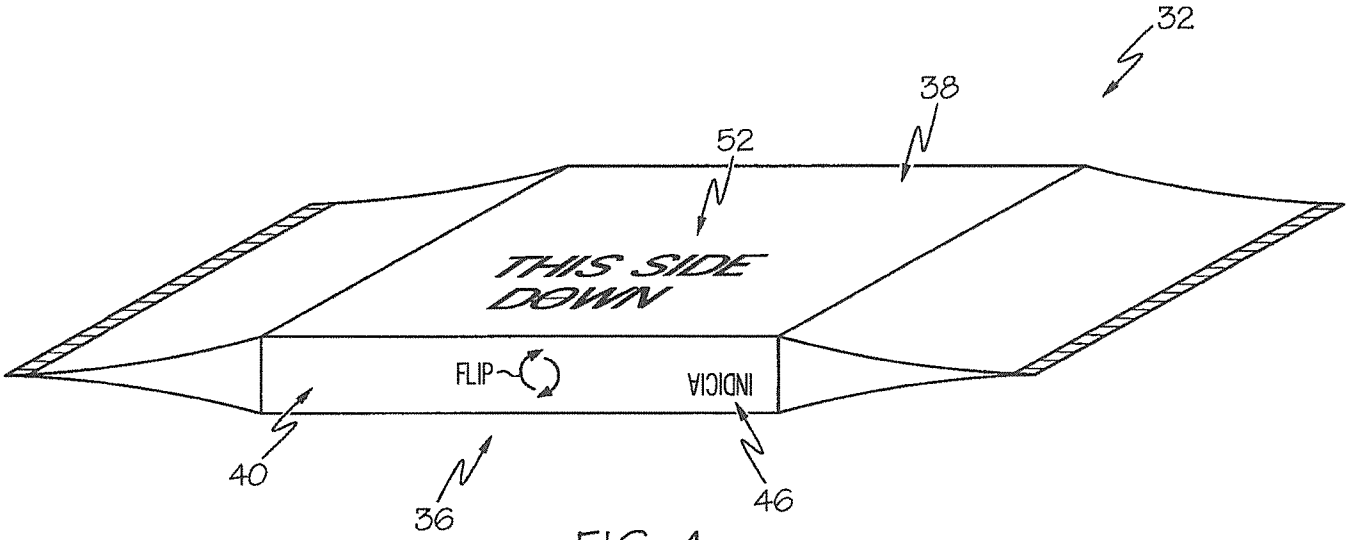
FIG. 4 is a perspective view of the package of FIG. 3 in an inverted, upside down orientation.

Referring to FIG. 4, the package 32 is illustrated in an upside down orientation where the top side 36 of the package 32 faces the floor surface and the bottom side 38 of the package 32 faces upward. In this upside down orientation, the indicia 46 may be oriented upside down. This upside down orientation of the indicia 46 may provide an indication that the package 32 should be inverted when placing the package 32 on display for user purchase. A further indication that the package 32 should be inverted is the opening feature 42 facing the floor surface. Thus, inverting the package 32 can place the indicia 46 in its right-side up orientation and the opening feature 42 facing upward as shown by FIG. 3. When in this upside down orientation, gravitational forces pull the composition (e.g., lotion) within the substrates in a direction from the bottom side 38 toward the top side 36 of the package.

Referring still to FIG. 4, the package 32 may further include instructional indicia 52 that provides predetermined turning schedule information for handling the package 32. For example, the instructional indicia 52 may be printed on the bottom side 38 (sidewalls 40 or top side 36) of the package and indicate "This Side Down," or some other suitable inversion instruction. Other text, icons and/or graphics may be used, such as arrows that instruct, cause and/or encourage an employee (or other person) to invert the package 32.

Figure 5:
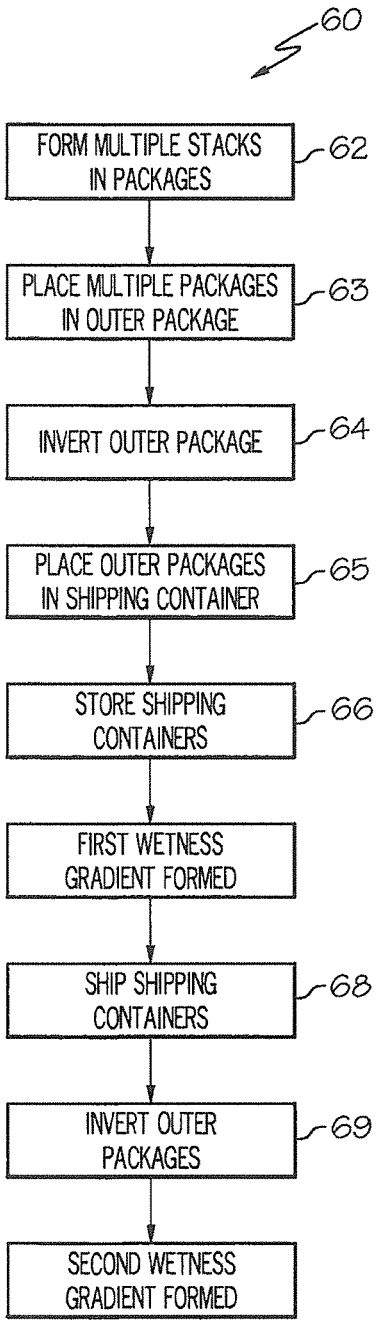
FIG. 5 illustrates another embodiment of a method of reducing a wetness gradient in a stack of wet wipes.

Referring to FIG. 5, another exemplary method 60 of reducing a wetness gradient in a stack of wet wipes includes forming multiple stacks of wet wipes in multiple packages at step 62 in a fashion similar to that described in FIG. 2. In this embodiment, multiple packages with the stacks of wet wipes are placed in an outer package or bag at step 63 to form an outer package containing multiple packaged stacks of wet wipes. The outer package may contain any suitable number of packages of wet wipes, such as one or more, such as two or more, such as three or more, such as ten or more, etc.

At step 64, once the packaged stacks of wet wipes are placed in the outer package, the outer package may be inverted and placed inside a shipping container upside down at step 65 with a top side of the outer package facing down (or toward a bottom of the shipping container, and ultimately a floor surface) and a bottom side of the outer package facing up (or toward a top of the shipping container). Step 64 may be referred to as an initial inversion of the stacks of wet wipes. As above, the initial inversion of the stacks of wet wipes may be performed according to a predetermined turning schedule.

Any suitable process may be used to provide the initial inversion of the stacks of wet wipes. In some embodiments, the initial inversion of the stacks of wet wipes and the outer package may be performed automatically using a packaging machine or the initial inversion of the outer package may be performed manually. In the embodiment of FIG. 5, the initial inversion of the outer package may performed at the manufacturing facility where the outer packages are placed upside down inside the shipping containers.

The initial inversion of the stacks of wet wipes is performed for multiple outer packages. In some embodiments, all of the outer packages of packaged wet wipes within a particular shipping container are inverted such that the top sides of the outer packages face down and the bottom sides of the outer packages face up within the shipping container. In other embodiments, only some of the outer packages of packaged wet wipes within a particular shipping container are inverted such that the top sides of the outer packages face down and the bottom sides of the outer packages face up.

At step 66, the shipping container of inverted outer packages or multiple shipping containers of inverted outer packages may be stored within the manufacturing facility or at a different location. In some embodiments, the shipping containers of inverted outer packages may be stored according to the predetermined turning schedule. As one example, the shipping containers of inverted outer packages may be stored for at least about 10 days or more, such as about 14 days or more, such as about 21 days or more with the outer packages in their upside down orientations and without any flipping of the packages.

At step 68, the shipping containers of inverted outer packages are shipped to a retail location in a fashion similar to that described above. At step 69, once the shipping containers are opened, the outer packages may be inverted according to the predetermined turning schedule. In this instance, the predetermined turning schedule may specify that the outer packages are to be inverted at the retail location. As one example, the outer packages may be inverted by an employee of the retail location as they are placed in a storage location or on a shelf for display such that the bottom side of the outer package faces down (e.g., toward a floor surface) and the top side of the outer package faces up (e.g., toward a ceiling surface). As another example, the shipping container may be inverted at the retail location and then opened such that the outer packages within the shipping container are inverted. Any suitable inversion method may be employed that rotates the outer packages 180 degrees for placement on display for user purchase.

Once the outer packages with the packaged wet wipes are inverted with top sides of the outer packages facing up and the bottom sides of the outer packages facing down, a second wetness gradient begins to form in each of the stacks of wet wipes in the outer packages. The second inversion of the stacks of wet wipes may occur after a predetermined period of time of the initial inversion, such as at least about 10 days, such as at least about 14 days, such as at least about 21 days, such as between about 10 days and about 21 days. The timing for the second inversion of the stacks of wet wipes may be selected to occur after the initial steady state wetness gradient develops, which can be determined by experiment. In other embodiments, the timing for the second inversion of the stacks of wet wipes may be selected to occur before the initial steady state wetness gradient develops, but after the initial wetness gradient begins to form.

Figure 6:
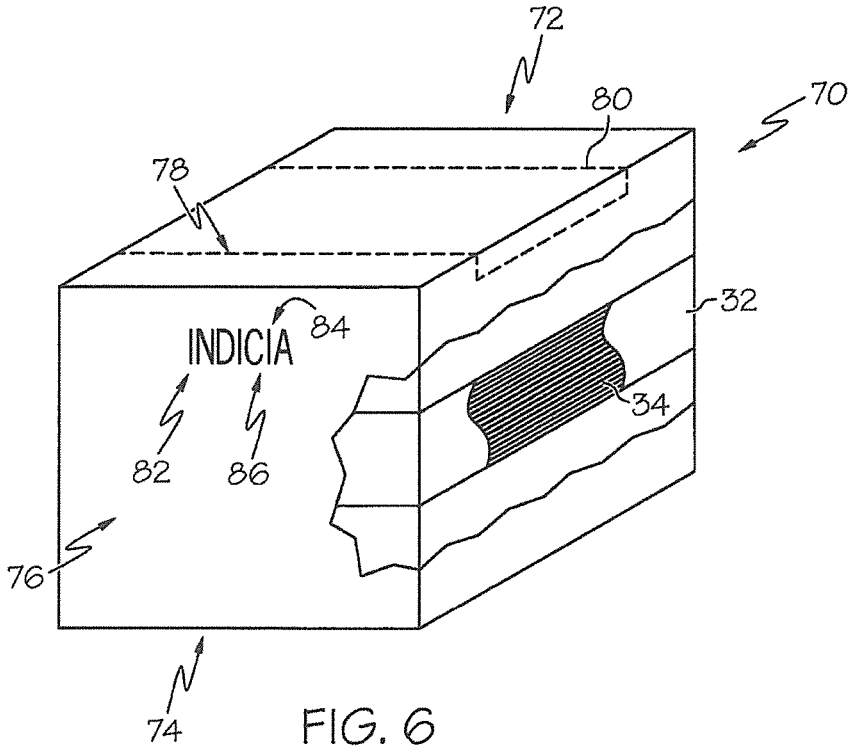
FIG. 6 is a perspective view of an embodiment of an outer package containing multiple packages of wet wipes in a right-side up orientation.

Referring to FIG. 6, an exemplary outer package 70 is illustrated in a right-side up orientation, which may be used to house multiple packages 32 of stacks of wet wipes 34. The outer package 70 includes a top side 72, a bottom side 74 and sidewalls 76 that extend from the top side 72 to the bottom side 74. The sidewalls 76, top side 72, and/or bottom side 74 of the outer package 70 need not be flaccid and/or resiliently deformable, as depicted, but may instead be freestanding and rigid. This flaccid arrangement may provide a package 70 with a somewhat amorphous shape. Material such as polyethylene film may be suitable if flaccid sidewalls, top side, and/or bottom side are selected for the outer package 70. Alternatively, the sides may be rigid. Suitable materials for rigid sides may include HDPE and PP.

The outer package 70 may include an opening feature 78. The opening feature 78 may be located at the top side 72 of the outer package 70. In some embodiments, the opening feature 78 may intercept the top side 72 and one of the other sidewalls 76 of the outer package 70, so that the packages 32 of stacks of wet wipes 34 may be removed from the outer package 70 by a reach-in manner. In some embodiments, the opening feature 78 may include a reclosable feature, such as a lid. In other embodiments, the opening feature 78 may include a tear line 80 (e.g., a perforated line or other line of weakness) that facilitates tearing of the outer package 70 to remove the packages 32.

The outer package 70 may include indicia 82 printed or attached thereon that is visible to the user from outside the package. At least some of the indicia 82 may have a generally right-side up orientation where a top 84 of the indicia 82 is closer to the top side 72 of the package 70 and a bottom 86 of the indicia 82 is closer to the bottom side 74 of the package 70. In some embodiments, the indicia 82 may be similar to or the same as the indicia 46 of the packages 32 of wet wipes (as shown in FIG. 4).

Figure 7:
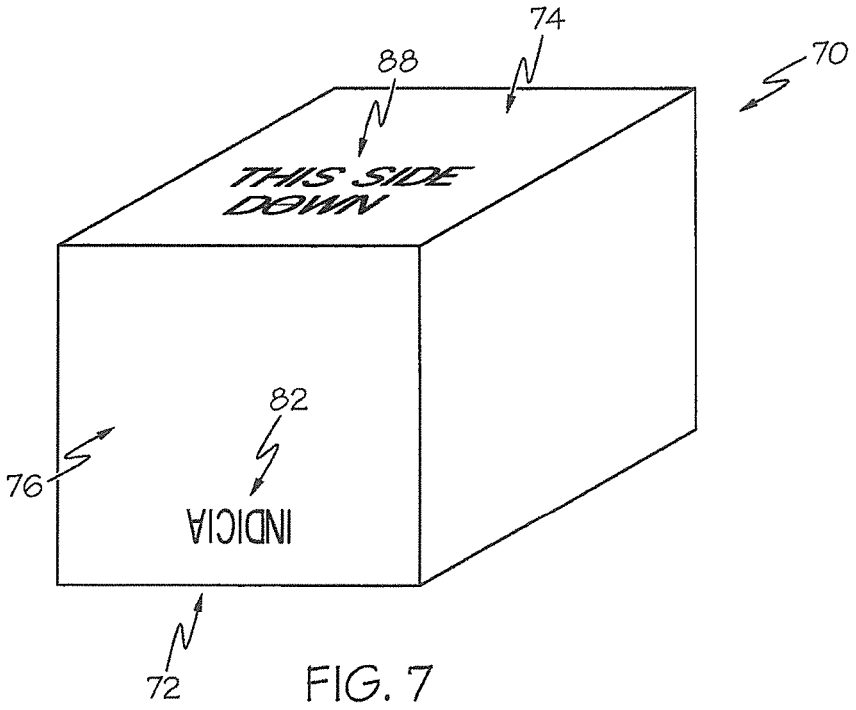
FIG. 7 is a perspective view of the outer package of FIG. 6 in an inverted, upside down orientation.

Referring to FIG. 7, the outer package 70 is illustrated in an upside down orientation where the top side 72 of the outer package 70 faces the floor surface and the bottom side 74 of the outer package 70 faces upward (e.g., toward a ceiling surface). In this upside down orientation, the indicia 82 may be oriented upside down. This upside down orientation of the indicia 82 may provide an indication that the outer package 70 should be inverted when placing the package 70 on display for user purchase. A further indication that the outer package 70 should be inverted is the opening feature 78 facing the floor surface. Thus, inverting the package 70 can place the indicia 82 in its right-side up orientation and the opening feature 78 facing upward as shown by FIG. 6.

As above with package 32, the outer package 70 may further include instructional indicia 88 that provides predetermined turning schedule information for handling the outer package 70. For example, the instructional indicia 88 may be printed on the bottom side 74 (sidewalls 76 or top side 72) of the outer package and indicate "This Side Down," or some other suitable inversion instruction. Other text, icons and/or graphics may be used, such as arrows that instruct, cause and/or encourage an employee (or other person) to invert the outer package 70.

As an alternative, the packages 32 of wet wipes 34 may be placed in the outer packages 70 in an upside down orientation such that the top sides 36 of the packages 32 face the bottoms sides 74 of the outer packages 70 and the bottom sides 38 of the packages 32 face the top sides 72 of the outer packages 70. In this arrangement, the user may invert the packages 32 of wet wipes when removed from the outer packages 70.

Figure 8:
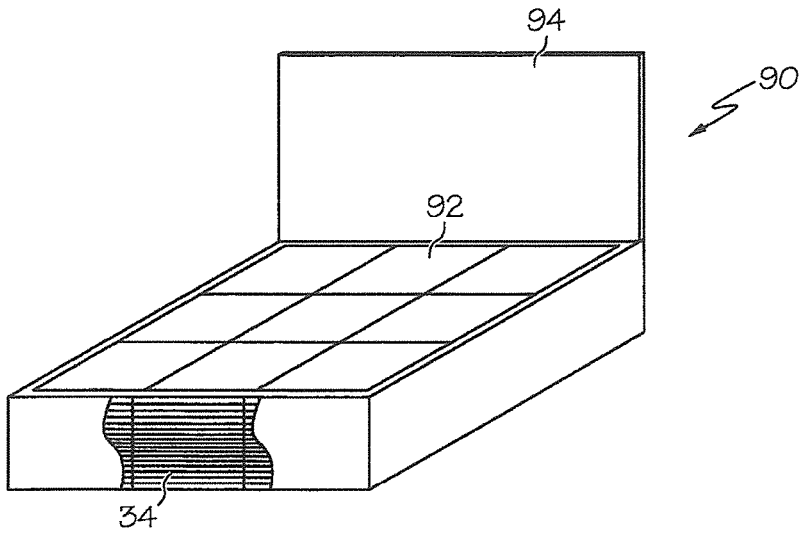
FIG. 8 is a perspective view of an embodiment of a temporary storage container for storing stacks of wet wipes.

Referring to FIG. 8, an embodiment of a temporary storage container 90 is used to temporarily store stacks 92 of wet wipes 34 prior to their placement in the packages 32. In this embodiment, "naked" (i.e., unwrapped) stacks 92 of wet wipes 34 are placed in the temporary storage container 90 and sealed therein using a lid 94 or other suitable moisture-tight enclosure. The stacks 92 of wet wipes 34 may be stored in the closed, temporary storage container 90 to allow the initial wetness gradient to form up to the initial steady state wetness gradient. As above, the stacks 92 of wet wipes 34 may be stored in the temporary storage container according to a predetermined turning schedule. In some embodiments, the stacks 92 of wet wipes 34 may be stored for at least about 10 days, such as at least about 14 days, such as at least about 21 days.

After storage, the temporary storage container 90 may be opened and each stack 92 of wet wipes 34 may be inverted and placed in a package 32 with the package in a right-side up orientation. Once the stacks 92 of wet wipes 34 are inverted and placed in the packages 32, a second wetness gradient begins to form in each stack 92. The second inversion of the stacks 92 of wet wipes 34 occurs after storage of the stacks 92 in the temporary storage container 90 and may be selected to occur after the initial steady state wetness gradient develops. In other embodiments, the timing for the second inversion of the stack of wet wipes may be selected to occur before the initial steady state wetness gradient develops, but after the initial wetness gradient begins to form.

Figure 9:
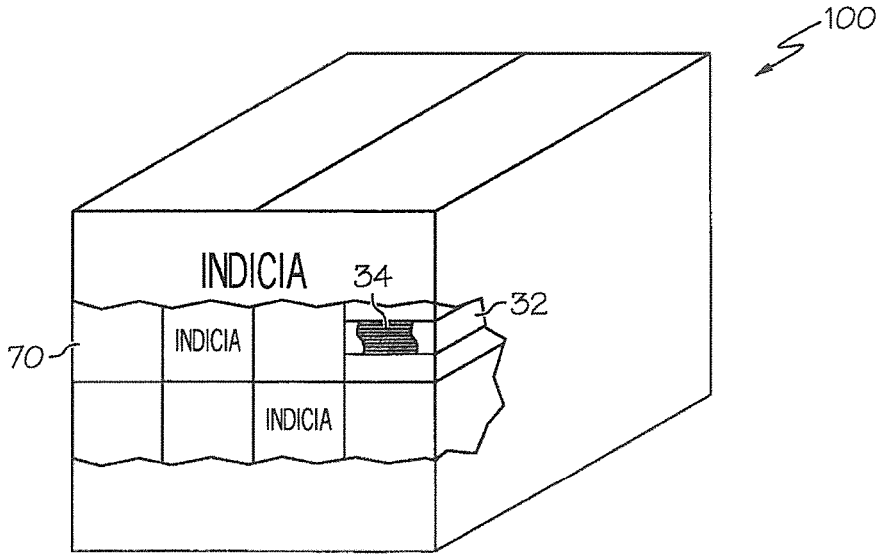
FIG. 9 is a perspective view of an embodiment of a shipping container including multiple outer packages in a right-side up orientation.
Figure 10:
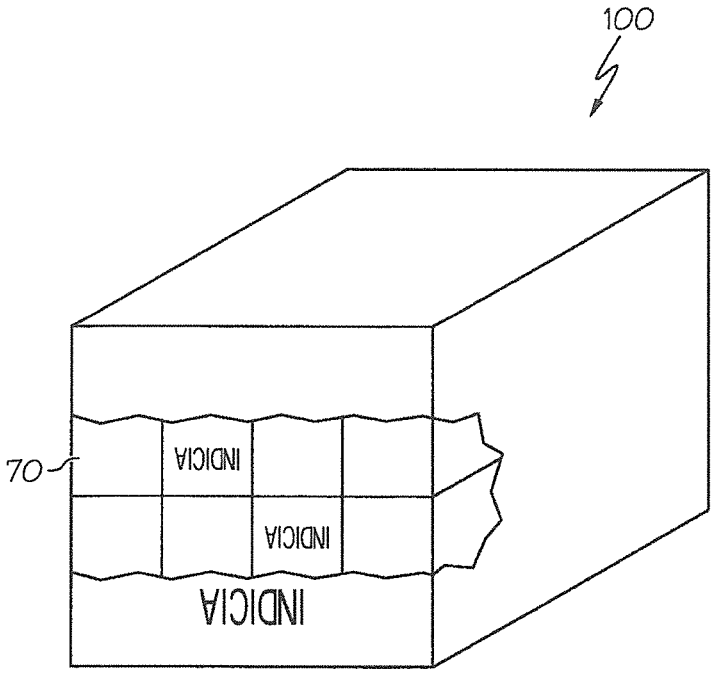
FIG. 10 is a perspective view of the shipping container of FIG. 9 in an inverted, upside down orientation.

Referring to FIG. 9, an exemplary shipping container 100 is illustrated containing multiple outer packages 70 with the packages 32 of wet wipes 34. As another exemplary method of reducing a wetness gradient in the stacks of wet wipes carried by the packages 32, the packages 32 may be placed in the outer packages in their right-side up orientations with the outer packages 70 in their right-side up orientations, as shown. The shipping container 100 may then be inverted as shown by FIG. 10. The shipping container 100 of inverted packages 32 of wet wipes 34 may be stored within the manufacturing facility or at a different location. In some embodiments, the shipping container 100 of inverted packages 32 of wet wipes 34 may be stored according to the predetermined turning schedule. As one example, the shipping container 100 of inverted packages 32 of wet wipes 34 may be stored for at least about 10 days or more, such as about 14 days or more, such as about 21 days or more with the packages 32 of wet wipes 34 in their upside down orientations and without any further flipping of the packages 32 or the shipping container 100. The shipping container 100 of inverted packages 32 of wet wipes 34 may then be shipped to a retail location where the shipping container 100 may be inverted. In another embodiment, the shipping container 100 may be inverted at the manufacturing facility prior to shipping. Once the shipping container 100 and the packages 32 with the wet wipes 34 are inverted with tops of the packages facing up and the bottoms of the packages facing down, a second wetness gradient begins to form.

Figure 11:
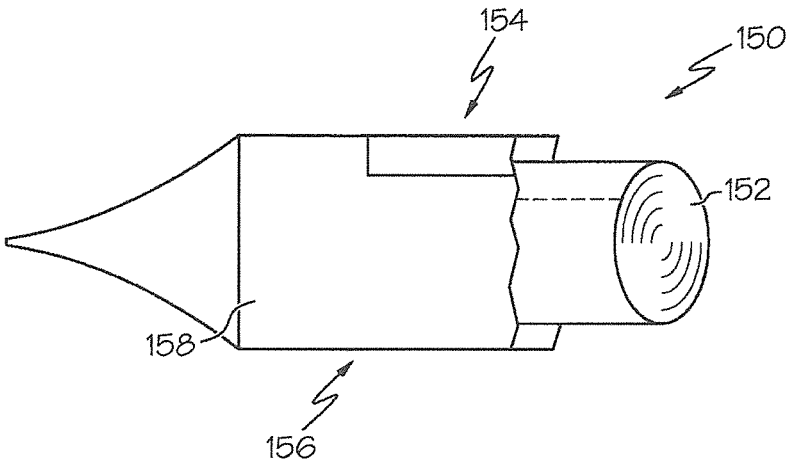
FIG. 11 is a side view of an embodiment of a package of wet wipes in roll form.

Stacks of substrates may also be in a roll form. Referring to FIG. 11, another exemplary flow wrap-type package 150 is illustrated in a right-side up orientation, which may be used to house a roll 152 of wet wipes. The package 150 includes a top side 154, a bottom side 156 and sidewalls 158 that extend from the top side 160 to the bottom side 162. The package 150 may include one or more of the features described above and be handled according to a predetermined turning schedule.

Figure 12:
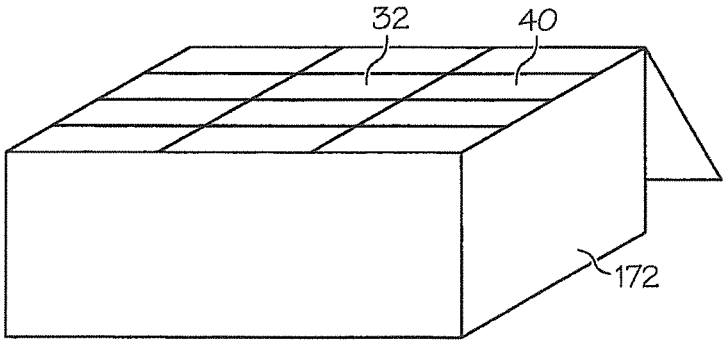
FIG. 12 is a perspective view of an embodiment of a shipping container including multiple packages of wet wipes packaged on their sides.

In some embodiments, the packages described above may be turned according to a predetermined turning schedule from one side to a different side, but less than 180 degrees. FIG. 12 illustrates packages 32 that are initially packaged within a shipping container 172 on their sidewalls 40. Referring back to FIG. 3, as another exemplary method of reducing a wetness gradient in the stacks of wet wipes carried by the packages 32, the packages 32 may be turned (e.g. 90 degrees) to the illustrated upright position.

Any substrate useful as a wet wipe may be used. Such substrates may comprise a molded fibrous structure. The substrate may be formed by any suitable process including, but not limited to, slitting, cutting, perforating, folding, stacking, interleaving, lotioning, and combinations thereof.

The material of which a substrate is made from should be strong enough to resist tearing during manufacture and normal use, yet still provide softness to the user's skin, such as a child's tender skin. Additionally, the material should be at least capable of retaining its form for the duration of the user's cleansing experience.

As set forth above herein, the substrate may be woven or nonwoven, foam, or films. In one embodiment, the substrate is a nonwoven and may be comprised of natural or synthetic fibers, or mixtures thereof. As used herein, "nonwoven" refers to a fibrous structure made from an assembly of continuous fibers, co-extruded fibers, non-continuous fibers and combinations thereof, without weaving or knitting, by processes such as spunbonding, carding, melt-blowing, air-laying, wet-laying, co-form, or other such processes known in the art for such purposes. The nonwoven structure may comprise one or more layers of such fibrous assemblies, wherein each layer may include continuous fibers, co-extruded fibers, non-continuous fibers and combinations thereof. The substrate may comprise fiber compositions that are a mix of hydrophilic fiber material such as viscose, cotton, or other natural and synthetic fibers and a hydrophobic fiber material such as polyethylene tetraphthalate (PET) or polypropylene (PP) in a ratio of from about 10% to about 90% hydrophilic and from about 90% to about 10% hydrophobic material by weight.

Substrates may be generally of sufficient dimension to allow for convenient handling. Typically, the substrate may be cut and/or folded to such dimensions as part of the manufacturing process. In some instances, the substrate may be cut into individual portions so as to provide separate wipes which are often stacked and interleaved in consumer packaging. In other embodiments, the substrates may be in a web form where the web has been slit and folded to a predetermined width and provided with means (e.g., perforations) to allow individual wipes to be separated from the web by a user. Suitably, the separate wipes may have a length between about 100 mm and about 250 mm and a width between about 140 mm and about 250 mm. In one embodiment, the separate wipe may be about 200 mm long and about 180 mm wide.

The material of the substrate may generally be soft and flexible, potentially having a structured surface to enhance its performance. The substrate may include laminates of two or more materials. Commercially available laminates, or purposely built laminates may be used. The laminated materials may be joined or bonded together in any suitable fashion, such as, but not limited to, ultrasonic bonding, adhesive, glue, fusion bonding, heat bonding, thermal bonding, hydroentangling and combinations thereof. In another alternative embodiment, the substrate may be a laminate comprising one or more layers of nonwoven materials and one or more layers of film. Examples of such optional films, include, but are not limited to, polyolefin films, such as, polyethylene film. An illustrative, but non-limiting example of a nonwoven sheet member is a laminate of a 16 gsm nonwoven polypropylene and a 0.8 mm 20 gsm polyethylene film.

The substrate materials may also be treated to improve the softness and texture thereof. The substrate may be subjected to various treatments, such as, but not limited to, physical treatment, such as ring rolling, as described in U.S. Pat. No. 5,143,679; structural elongation, as described in U.S. Pat. No. 5,518,801; consolidation, as described in U.S. Pat. Nos. 5,914,084, 6,114,263, 6,129,801 and 6,383,431; stretch aperturing, as described in U.S. Pat. Nos. 5,628,097, 5,658,639 and 5,916,661; differential elongation, as described in WO Publication No. 2003/0028165A1; and other solid state formation technologies as described in U.S. Publication No. 2004/0131820A1 and U.S. Publication No. 2004/0265534A1, zone activation, and the like; chemical treatment, such as, but not limited to, rendering part or all of the substrate hydrophobic, and/or hydrophilic, and the like; thermal treatment, such as, but not limited to, softening of fibers by heating, thermal bonding and the like; and combinations thereof, which are all hereby incorporated by reference herein in their entirety.

The substrate may have a basis weight of at least about 30 grams/$m^2$. The substrate may have a basis weight of at least about 40 grams/$m^2$. In one embodiment, the substrate may have a basis weight of at least about 45 grams/$m^2$. In another embodiment, the substrate basis weight may be less than about 75 grams/$m^2$. In another embodiment, substrates may have a basis weight between about 40 grams/$m^2$ and about 75 grams/$m^2$, and in yet another embodiment a basis weight between about 40 grams/$m^2$ and about 65 grams/$m^2$. The substrate may have a basis weight between about 30, 40, or 45 and about 50, 55, 60, 65, 70 or 75 grams/$m^2$.

A suitable substrate may be a carded nonwoven comprising a 40/60 blend of viscose fibers and polypropylene fibers having a basis weight of 58 grams/$m^2$ as available from Suominen of Tampere, Finland as FIBRELLA 3160. Another suitable material for use as a substrate may be SAWATEX 2642 as available from Sandler AG of Schwarzenbach/Salle, Germany. Yet another suitable material for use as a substrate may have a basis weight of from about 50 grams/$m^2$ to about 60 grams/$m^2$ and have a 20/80 blend of viscose fibers and polypropylene fibers. The substrate may also be a 60/40 blend of pulp and viscose fibers. The substrate may also be formed from any of the following fibrous webs such as those available from the J.W. Suominen Company of Finland, and sold under the FIBRELLA trade name. For example, FIBRELLA 3100 is a 62 gsm nonwoven web comprising 50% 1.5 denier polypropylene fibers and 50% 1.5 denier viscose fibers. In both of these commercially available fibrous webs, the average fiber length is about 38 mm. Additional fibrous webs available from Suominen may include a 62 gsm nonwoven web comprising 60% polypropylene fibers and 40% viscose fibers; a fibrous web comprising a basis weight from about 50 or 55 to about 58 or 62 and comprising 60% polypropylene fibers and 40% viscose fibers; and a fibrous web comprising a basis weight from about 62 to about 70 or 75 gsm. The latter fibrous web may comprise 60% polypropylene fibers and 40% viscose fibers. Substrates may be tri-blends of suitable materials such as PET, PP and viscose, for example, in a 40/40/20 ratio.

In one embodiment, the surface of the substrate may be essentially flat. In another embodiment of the present invention the surface of the substrate may optionally contain raised and/or lowered portions. These can be in the form of logos, indicia, trademarks, geometric patterns, images of the surfaces that the substrate is intended to clean (i.e., infant's body, face, etc.). They may be randomly arranged on the surface of the substrate or be in a repetitive pattern of some form.

In another embodiment, the substrate may be biodegradable. For example, the substrate could be made from a biodegradable material such as a polyesteramide, or a high wet strength cellulose.

The substrate is generally impregnated with a composition such as a liquid or semi liquid cleaning lotion, intended to facilitate cleaning and/or provide a smooth feeling to the skin after use. Other ingredients or actives (for example cosmetic actives) can be part of the composition.

Generally, the composition (e.g., cleaning lotion) is of sufficiently low viscosity to disperse solid soils disposed on the skin and to facilitate impregnation of the structure of the wipe. In some other instances, the composition can be primarily present at the wipe surface and to a lesser extent in the inner structure of the wipe. Suitably the substrate is impregnated with at least about 2 times its weight with the cleaning lotion. In one embodiment, the wipe is impregnated with at least about 2.5 times its weight, with at least about 3 times its weight, such as with at least about 5 times its weight. Alternatively, impregnation to greater than about 6 times its weight may be undesirable; in one embodiment, the substrate is impregnated to less than about 6 times its weight.

The substrate may releasably carry the cleaning lotion, that is, the composition is contained either in or on the substrate and is readily releasable from the substrate by applying a relatively low force to the substrate (e.g., wiping a surface, such as the skin in the perianal area, with the wet wipe).

The composition may comprise an emollient, a particulate material, a surfactant and/or an emulsifier, a rheology modifier, and water. Other ingredients may be incorporated into the composition, including, but not limited to, soothing agents, botanicals, skin health agents and preservatives. It is to be noted that some compounds can have a multiple function and that all compounds are not necessarily present in the composition of the invention. In one embodiment, the cleaning composition of the present invention is an oil-in-water emulsion.

Suitable compositions include those described in U.S. Publication Nos. 2005/0008680A1, 2005/0008681A1, 2006/0171971A1, 2007/0286893A1, and 2007/0286894A1, in WO Publication Nos. 20051004834A1, 2005/007128A1, 2007/144814A1, and 2007/144819A1, and in U.S. Pat. No. 5,648,083 (issued Jul. 15, 1997 to Bleszner and Decker), U.S. Pat. No. 6,641,826 (issued Nov. 4, 2002 to Durden), U.S. Pat. No. 6,613,729 (issued Sep. 2, 2003 to Cole et al.), U.S. Pat. No. 6,673,358 (issued Jan. 6, 2004 to Cole et al.), and U.S. Pat. No. 7,666,827 (issued Feb. 23, 2010 to Marsh et al.), which are hereby incorporated by reference herein in their entirety.

Emollients useful in the present invention may include silicone oils, functionalized silicone oils, hydrocarbon oils, fatty alcohols, fatty alcohol ethers, fatty acids, esters of monobasic and/or dibasic and/or tribasic and/or polybasic carboxylic acids with mono and polyhydric alcohols, polyoxyethylenes, polyoxypropylenes, mixtures of polyoxyethylene and polyoxypropylene ethers of fatty alcohols, and mixtures thereof. The emollients may be either saturated or unsaturated, have an aliphatic character and be straight or branched chained or contain alicyclic or aromatic rings.

A useful mixture of emollients is caprylic capric triglycerides in combination with Bis-PEG/PPG-16/16 PEG/PPG-16/16 dimethicone known as ABIL CARE™ 85 (available from Degussa Care Specialties of Hopewell, Va.).

The emollient content of the composition may be from about 0.001% to less than about 5%, from about 0.001% to less than about 3%, from about 0.001% to less than about 2.5%, from about 0.001% to less than about 1.5%.

Compositions may comprise a particulate material. Suitable commercially available particulate materials include but are not limited to: polyethylene powders are available from Honeywell International of Morristown, N.J. under the trade name ACUMIST; polymethyl methacrylate microspheres as are available from KOBO of South Plainfield, N.J. as BPA; lactone cross polymer microspheres as are available from KOBO as BPD; nylon 12 microspheres as are available from KOBO as NYLON SP; polymethylsilsesquioxane microspheres as are available from KOBO as TOSPEARL; cellulose microspheres as are available from KOBO as CELLOBEADS; silica microspheres as are available from KOBO as MSS; polytetrafluoroethylene powders as are available from Micro Powders, Inc. of Tarrytown, N.Y. as MICROSLIP; micronized waxes as are available from Micro Powders as MICROEASE; blends of natural wax and micronized polymers as are available form Micro Powders as MICROCARE and microspherical particles of a copolymer of vinylidene chloride, acrylonitrile and methylmethacrylate available as EXPANCEL from Expancel, Inc. of Duluth, Ga. Useful are polyolefin powders as are available from Equistar Chemical Corp. Houston, Tex. as MICROTHENE, MICROTHENE FN510-00 from Equistar.

The composition may comprise less than about 2.5% particulate material, less than about 1.5%, less than about 1.0%. The composition may have a particulate concentration between about 0.01% and about 1.0%, between about 0.4% and about 0.6%.

The composition may comprise one or more surfactants. The surfactant may be a polymeric surfactant or a non-polymeric one. The surfactant may be employed as an emulsifier. The surfactant, when present, may be employed in an amount effective to emulsify the emollient and any other non-water-soluble oils that may be present in the composition.

The surfactant or combinations of surfactants may be mild, which means that the surfactants provide sufficient cleansing or detersive benefits but do not overly dry or otherwise harm or damage the skin.

A wide variety of surfactants are useful herein and include those selected from the group consisting of anionic surfactants, nonionic surfactants, cationic surfactants, amphoteric surfactants, zwitterionic surfactants, and mixtures thereof.

A wide variety of anionic surfactants are useful herein. Non-limiting examples of anionic surfactants include those selected from the group consisting of sarcosinates, sulfates, sulfonates, isethionates, taurates, phosphates, lactylates, glutamates, and mixtures thereof. Amongst the isethionates, the alkoyl isethionates are useful, and amongst the sulfates, the alkyl and alkyl ether sulfates are useful. Other anionic materials useful herein are soaps (i.e., alkali metal or amine salts, e.g., sodium, potassium or triethanol amine salts) of fatty acids, typically having from about 8 to about 24 carbon atoms.

Nonionic surfactants useful herein include, but are not limited to, those selected from the group consisting of alkyl glucosides, alkyl polyglucosides, polyhydroxy fatty acid amides, alkoxylated fatty acid esters, alkoxylated fatty alcohol ethers, sucrose esters, amine oxides, and mixtures thereof.

Suitable amphoteric or zwitterionic surfactants for use in the compositions herein include those which are known for use in hair care or other personal care cleansing. Amphoteric surfactants suitable for use in the present compositions are well known in the art and include those surfactants broadly described as derivatives of aliphatic secondary and tertiary amines in which the aliphatic radical can be straight or branched chain and wherein one of the aliphatic substituents contains from about 8 to about 18 carbon atoms and one contains an anionic water solubilizing group such as carboxy, sulfonate, sulfate, phosphate, or phosphonate. Useful amphoteric surfactants include, but are not limited to, the group consisting of cocoamphoacetate, cocoamphodiacetate, lauroamphoacetate, lauroamphodiacetate, and mixtures thereof.

Zwitterionic surfactants suitable for use herein include those surfactants broadly described as derivatives of aliphatic quaternary ammonium, phosphonium, and sulfonium compounds, in which the aliphatic radicals can be straight or branched chain, and wherein one of the aliphatic substituents contains from about 8 to about 18 carbon atoms and one contains an anionic group such as carboxy, sulfonate, sulfate, phosphate or phosphonate. Useful zwitterionic detersive surfactants are the betaines, amphoacetates and sulfobetaines, e.g., cocoamidopropylbetaine, sodiumlaurylamphoacetate and cocoamidopropylhydroxysultaine.

The surfactant may be present in the composition in an amount ranging from about 0.5%, 1%, or 4% w/w to about 0.001%, 0.01% or 0.02% w/w (based on the weight surfactant over the weight of the composition).

The composition may comprise a rheology modifier. Suitable rheology modifiers include, but are not limited to, sodium polyacrylate; ammonium acrylodimethyltaurate/VP copolymer; a mixture of caprylic/capric triglyceride and ammonium acryloyldimethyltaurate/VP copolymer, trilaureth-4 phosphate and polyglyceryl-2 sesquiisostearate, available as Aristoflex AVL from Clariant; a mixture of caprylic/capric triglyceride and ammonium acryloyldimethyltaurate/beheneth-25 methacrylate crosspolymer, available as Aristoflex HML from Clariant; ammonium acryloyldimethyltaurate/beheneth-25 methacrylate crosspolymer, available as Aristoflex HMB from Clariant; a mixture of sodium polyacrylate, C13-14 isoparaffin, and trideceth-6, available as Aristoflex PAL 30 from Clariant; a mixture of sodium polyacrylate, hydrogenated polydecene, and trideceth-6, available as Aristoflex PAL 57 from Clariant; acrylic acid/VP crosspolymer, available as Ultrathix P-100 from ISP; acrylates/C10-30 alkyl acrylate crosspolymer, available as CARBOPOL Ultrez 20, from Lubrizol; a mixture of sodium acrylate/sodium acryloyldimethyl taurate copolymer, isohexadecane, and polysorbate 80, available as Simulgel EG from Seppic; a mixture of hydroxyethyl acrylate/sodium acryloyldimethyl taurate copolymer, isohexadecane, and polysorbate 60, available as Simulgel INS 100 from Seppic; a mixture of polyacrylate-X, isohexadecane, and polysorbate 60, available as Simulgel SMS 88 from Seppic; a mixture of polyacrylamide, C13-14 isoparaffin, and laureth-7, available as Sepigel 305 from Seppic; acrylates/vinyl isodecanoate crosspolymer available as Stabylen 30 from 3V; acrylates/C10-30 alkyl acrylate crosspolymer, available as Pemulen TR1 and TR2 from Lubrizol; hydrocolloids of plant or biosynthetic origin, for example, xanthan gum, karaya gum, alginates, sclerotium gum, galactoarabinan, diutan gum, guar gum, locust bean gum, and gellan gum; fumed silicas and treated silicas; silicates; starch and its hydrophilic derivatives; polyurethanes; and mixtures thereof.

Rheology modifiers, when present may be used at a weight/weight % (w/w) from about 0.01% to about 3%, from about 0.015% to about 2%, from about 0.02% to about 1%.

The composition may optionally include an adjunct ingredient. The adjunct ingredient may include a wide range of additional ingredients such as, but not limited to perfumes, fragrances, preservatives, moisturizers, texturizers, pH buffers, metal sequestrants, humectants, colorants, medically active ingredients, in particular healing actives and skin protectants. Combinations of adjunct ingredients may also be used.

Humectants are hygroscopic materials that function to draw water into the stratum corneum to hydrate the skin. The water may come from the dermis or from the atmosphere. Examples of humectants include glycerin, propylene glycol, and phospholipids.

Fragrance components, such as perfumes, include, but are not limited to water insoluble oils, including essential oils.

Preservatives prevent the growth of micro-organisms in the liquid lotion and/or on the substrate. Generally, such preservatives are hydrophobic or hydrophilic organic molecules. Suitable preservatives include, but are not limited to parabens, such as methyl parabens, propyl parabens, alkyl glycinates, iodine derivatives, quaternary ammonium salts (e.g., benzalkonium chloride) and combinations thereof. Preservative systems are disclosed in published US Pat. Application No. 2004/022158 and in U.S. patent application Ser. No. 10/878,875.

The above-described product handling methods allows a first wetness gradient to form in a stack of wet wipes and then the stacks are inverted according to a predetermined turning schedule to allow a second wetness gradient to form in the stacks. In this manner, the wetness gradient can be significantly reduced compared to only allowing the initial wetness gradient to form. This can provide the consumer with the stack of wet wipes having a wetness ratio closer to one (as opposed to closer to 2 from top to bottom), which has been found to be desirable to the customer.

In one test, a stack of 72 spun-pulp-carded substrates having a 260 percent lotion load was tested as set forth above in the Determining Impact of Stack Inversion on Wetness gradient section. Unflipped stacks exhibited a wetness gradient of 1.457. Meanwhile, the flipped stacks exhibited a wetness gradient of 1.199.

In another test, a stack of 63 carded spunlaced substrates having a 350 percent lotion load was tested as set forth above in the Determining Impact of Stack Inversion on Wetness gradient section. Unflipped stacks exhibited a wetness gradient of 1.621. Meanwhile, the flipped stacks exhibited a wetness gradient of 1.172.

It is noted that terms like "preferably," "generally," "commonly," and "typically" are not utilized herein to limit the scope of the claimed embodiments or to imply that certain features are critical, essential, or even important to the structures or functions. Rather, these terms are merely intended to highlight alternative or additional features that may or may not be utilized in a particular embodiment.

For the purposes of describing and defining the various embodiments it is additionally noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

All documents cited in the Detailed Description are, in relevant part, incorporated herein by reference; the citation of any document is not to be construed as an admission that it is prior art. To the extent that any meaning or definition of a term in this written document conflicts with any meaning or definition of the term in a document incorporated by reference, the meaning or definition assigned to the term in this written document shall govern.

While particular embodiments have been illustrated and described, it would be obvious to those skilled in the art that various other changes and modifications can be made without departing from the spirit and scope of the invention. It is therefore intended to cover in the appended claims all such changes and modifications that are within the scope of this invention.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of reducing a wetness gradient development for a package of wet wipes, the method comprising:

after wet wipes are enclosed within a package to form the package of wet wipes, locating the package of wet wipes in a first orientation such that a first side of the package of wet wipes faces downward and an opposite second side of the package of wet wipes faces upward to form a first wetness gradient after a preselected amount of time; and prior to opening the package of wet wipes to access the wet wipes enclosed within the package of wet wipes, inverting the package of wet wipes according to a predetermined turning schedule to place the package of wet wipes in a second orientation such that the first side of the package of wet wipes faces upward and the second side of the package of wet wipes faces downward to form a second wetness gradient that is different from the first wetness gradient;

wherein the second wetness gradient is less than the first wetness gradient, wherein the first wetness gradient is determined at least about 10 days after the package of wet wipes being placed in the first orientation and the second wetness gradient is determined at least about 10 days after the package of wet wipes being placed in the second orientation.

2. The method of claim 1, wherein the wet wipes are packaged within the package of wet wipes in a stack.

3. The method of claim 1 further comprising placing the package of wet wipes in the first orientation by inverting an outer secondary package including multiple packages of wet wipes located in the outer secondary package.

4. The method of claim 3 further comprising placing the outer secondary package including the multiple packages of wet wipes in a shipping container with the multiple packages of wet wipes in the first orientation.

5. The method of claim 3 further comprising:

placing the outer secondary package including the multiple packages of wet wipes in the second orientation;

placing the outer secondary package in a shipping container with the multiple packages in the second orientation; then placing the multiple packages of wet wipes in the first orientation by inverting the shipping container with the outer secondary package located therein.

6. The method of claim 1 further comprising placing the package of wet wipes in the first orientation within an outer secondary package such that the first side of the package of wet wipes faces a bottom of the outer secondary package and the second side of the package of wet wipes faces a top of the outer secondary package.

7. The method of claim 1, wherein the first side is a dispensing side through which the wet wipes are removed from the package of wet wipes, the package of wet wipes including an opening feature located at the first side of the package of wet wipes that facilitates customer access to the wet wipes located in the package of wet wipes.

8. A package of wet wipes formed by the method of claim 1.

9. A method of reducing wetness gradient development for multiple packages of wet wipes prior to consumer purchase, the method comprising:

locating the multiple packages of wet wipes, the multiple packages of wet wipes being in a first orientation such that a first side of each multiple package of wet wipes faces downward and a second side of each multiple package of wet wipes faces upward; and inverting the multiple packages of wet wipes at least about 24 hours after the multiple packages of wet wipes are placed in their first orientations to place the multiple packages of wet wipes in a second orientation such that the first side of each multiple package of wet wipes faces upward and the second side of each multiple package of wet wipes faces downward prior to sale of the multiple packages of wet wipes to a consumer.

10. The method of claim 9, wherein inverting the multiple packages of wet wipes to place the multiple packages of wet wipes in the second orientation is performed at a retail location.

11. The method of claim 10, wherein the multiple packages of wet wipes are placed in the first orientation at a location different from the retail location.

12. The method of claim 9, wherein inverting the multiple packages of wet wipes to place the multiple packages of wet wipes in the second orientation is performed at a packaging location.

13. The method of claim 9, wherein inverting the multiple packages of wet wipes at least about 24 hours after the multiple packages of wet wipes are placed in the first orientation to place the multiple packages of wet wipes in the second orientation includes inverting multiple outer secondary packages with the multiple packages of wet wipes being located in the multiple outer secondary packages.

14. The method of claim 13, wherein the multiple outer secondary packages are inverted while in a shipping container.

15. The method of claim 14, wherein the wet wipes are packaged in a stack within the multiple packages of wet wipes.

16. A method of reducing wetness gradient development for multiple packages of wet wipes prior to consumer purchase, the method comprising:

locating the multiple packages of wet wipes with the wet wipes located therein in stacks, the multiple packages of wet wipes being in an upside down orientation such that a top of each multiple package of wet wipes faces downward and a bottom of each multiple package of wet wipes faces upward; and prior to opening the multiple packages of wet wipes to access the wet wipes within the multiple packages, inverting the multiple packages of wet wipes from their upside down orientations to a right-side up orientation such that the top of each multiple package of wet wipes faces upward and the bottom of each multiple package of wet wipes faces downward;

wherein the stacks of wet wipes of the multiple packages of wet wipes have a wetness gradient of no greater than about 1.3 at least about 10 days after being inverted from the upside down orientation to the right-side up orientation and prior to opening the multiple packages of wet wipes.

17. The method of claim 16, wherein the wetness gradient is a second wetness gradient of no greater than about 1.3 at least about 10 days after being inverted from the inverted orientation to the right-side up orientation, wherein the stack of wet wipes have a first wetness gradient of no less than about 1.3 at least about 10 days after being placed in the upside down orientation and prior to inverting the multiple packages of wet wipes from the upside down orientation to the right-side up orientation.

18. The method of claim 16, wherein inverting the multiple packages of wet wipes from the upside down orientation to the right-side up orientation includes inverting an outer secondary package including multiple ones of the multiple packages of wet wipes located in the outer secondary package such that a top of the outer secondary package faces upward and a bottom of the outer secondary package faces downward.

19. The method of claim 18 further comprising removing the outer secondary package from a shipping container, the outer secondary package being in an upside down orientation within the shipping container such that the top of the outer secondary package faces downward and the bottom of the outer secondary package faces upward.

20. A method of reducing a wetness gradient development for a package of wet wipes, the method comprising:

after wet wipes are enclosed within a package to form the package of wet wipes, locating the package of wet wipes in a first orientation such that a first side of the package of wet wipes faces downward and an opposite second side of the package of wet wipes faces upward to form a first wetness gradient after a preselected amount of time; and prior to opening the package of wet wipes to access the wet wipes enclosed within the package of wet wipes, inverting the package of wet wipes according to a predetermined turning schedule to place the package of wet wipes in a second orientation such that the first side of the package of wet wipes faces upward and the second side of the package of wet wipes faces downward to form a second wetness gradient that is different from the first wetness gradient;

further comprising placing the package of wet wipes in the first orientation by inverting an outer secondary package including multiple packages of wet wipes located in the outer secondary package.

21. The method of claim 20 further comprising placing the package of wet wipes in the first orientation by inverting an outer secondary package including multiple packages of wet wipes located in the outer secondary package.

22. The method of claim 21 further comprising placing the outer secondary package including the multiple packages of wet wipes in a shipping container with the multiple packages of wet wipes in the first orientation.

23. The method of claim 21 further comprising:

placing the outer secondary package including the multiple packages of wet wipes in the second orientation;

placing the outer secondary package in a shipping container with the multiple packages in the second orientation; then placing the multiple packages of wet wipes in the first orientation by inverting the shipping container with the outer secondary package located therein.

24. The method of claim 20 further comprising placing the package of wet wipes in the first orientation within an outer secondary package such that the first side of the package of wet wipes faces a bottom of the outer secondary package and the second side of the package of wet wipes faces a top of the outer secondary package.

25. The method of claim 20, wherein the first side is a dispensing side through which the wet wipes are removed from the package of wet wipes, the package of wet wipes including an opening feature located at the first side of the package of wet wipes that facilitates customer access to the wet wipes located in the package of wet wipes.

26. A package of wet wipes formed by the method of claim 20.

* * * * *